US006390034B1

(12) United States Patent
Orzal et al.

(10) Patent No.: US 6,390,034 B1
(45) Date of Patent: May 21, 2002

(54) RECIPROCATING IMPACT TOOL HAVING TWO-CYCLE ENGINE OIL SUPPLY SYSTEM

(75) Inventors: Gregory J. Orzal, Hartford; David W. Ambrose, Hubertus; Todd Skibinski, Milwaukee, all of WI (US)

(73) Assignee: Wacker Corporation, Menomonee Falls, WI (US)

( * ) Notice: Subject to any disclaimer, the term of this patent is extended or adjusted under 35 U.S.C. 154(b) by 6 days.

(21) Appl. No.: 09/732,376

(22) Filed: Dec. 7, 2000

(51) Int. Cl.[7] ..... F02B 33/04
(52) U.S. Cl. ..... 123/73 AD; 123/196 R
(58) Field of Search ..... 123/73 AD, 196 R

(56) References Cited

U.S. PATENT DOCUMENTS

| | | | | |
|---|---|---|---|---|
| 4,170,427 A | | 10/1979 | Grane | |
| 4,480,602 A | * | 11/1984 | Kobayashi et al. | 123/73 AD |
| 4,887,559 A | | 12/1989 | Hensel et al. | |
| 4,976,246 A | | 12/1990 | Schierling et al. | |
| 5,239,967 A | | 8/1993 | Adam | |
| 5,829,395 A | | 11/1998 | Brenny et al. | |
| 5,887,563 A | * | 3/1999 | Shudo et al. | 123/196 R |
| 5,941,745 A | * | 8/1999 | Kanno | 123/73 AD |
| 6,006,705 A | * | 12/1999 | Kato et al. | 123/73 AD |
| 6,082,322 A | * | 7/2000 | Graham et al. | 123/73 AD |

OTHER PUBLICATIONS

Multiquip Inc. product brochure, "10 reasons why Multiquip Oil–Injection Rammers are the favorite of the rental industry."

Multiquip Inc. product brochure (Japanese version—no translation available), "Tamping Rammer with Self–Contained, Trouble–Free Gasoline Engine Driven," p. 35.

* cited by examiner

*Primary Examiner*—Marguerite McMahon
(74) *Attorney, Agent, or Firm*—Boyle Fredrickson Newholm Stein & Gratz S.C.

(57) ABSTRACT

A reciprocating impact tool such as a rammer or a breaker is provided with a lubricating oil supply system that supplies lubricating oil to a fuel supply line of the tool's two-cycle engine, thereby eliminating the need to premix the fuel and oil. The oil is supplied at a rate that varies with the speed of the reciprocating member of the tool, thereby assuring that the fuel and oil are mixed in the proper proportions. The oil pump delivers oil to the fuel supply line well-upstream of the engine's carburetor or other fuel supply device, thereby taking advantage of movement and vibration of the reciprocating member to assure that the delivered oil is thoroughly mixed with the fuel in the fuel line before the mixture is inducted into the engine's combustion chamber, leading to complete atomization of the oil and resultant benefits, including improved lubrication and complete combustion of the oil. The invention requires no modifications to the existing engine crankcase design because the oil supply system's pump is coupled to and driven by the reciprocating member's drive train as opposed to the engine.

22 Claims, 9 Drawing Sheets

RECIPROCATING IMPACT TOOL HAVING TWO-CYCLE ENGINE OIL SUPPLY SYSTEM

BACKGROUND OF THE INVENTION

1. Field of the Invention

The invention relates to reciprocating impact tools such as rammers and breakers and, more particularly, to a reciprocating impact tool powered by a two-cycle engine which has a lube oil supply system for transferring lubricating oil to a fuel supply line of the engine. The invention additionally relates to a method of operating such an impact tool and a method for its assembly.

2. Discussion of the Related Art

Reciprocating impact tools are used in a variety of compacting and breaking applications. The typical reciprocating impact tool includes an impacting member that is driven by a dedicated engine to impact against the ground to perform the desired function. Examples of reciprocating impact tools of this type are rammers and breakers. In a rammer, the impacting member comprises a pad or shoe that is driven to vertically reciprocate against the ground to compact it in preparation for a paving operation or the like. In a breaker, the impacting member comprises a bar or hammer that is driven to vertically reciprocate against the ground to fracture pavement or the like. The impacting member of each type of tool is typically driven by an eccentric crank that, in turn, is driven by a clutch and a gear train coupled to the tool's engine.

Many reciprocating impact tools are powered by two-cycle engines. Two-cycle engines have the advantage of exhibiting a very high power-to-weight ratio, hence permitting the use of relatively powerful engines on tools that can be manually operated and manually transported. However, they have the potential disadvantage of being fueled by a gasoline/lubricating oil mixture rather than straight gasoline. The gasoline and oil are premixed and stored in the engine's fuel tank. Proper operation of the engine depends upon the operator's ability or willingness to properly premix the gasoline and lubricating oil in the tank. If too little oil is premixed with the gasoline, the engine is inadequately lubricated, can overheat, and may wear rapidly or even fail. If too much oil is premixed with the gasoline, engine performance is degraded and emissions are increased. This problem is serious because the gasoline and oil often are mixed in the field under less than optimal conditions. The operator may not have the proper equipment to measure the required quantities of gasoline and oil to obtain appropriate fuel oil ratios.

Attempts have been made to solve this problem by providing an oil injection system that injects a controlled quantity of lubricating oil into an engine's fuel supply system, thereby negating the need to premix fuel and oil. The oil injection system includes an oil pump that transfers oil from an oil tank to the fuel supply system at a rate that results in the induction of an acceptable fuel/oil mixture into the engine's combustion chamber(s). However, known attempts to eliminate the need to premix fuel and oil have met with only partial success.

For instance, one known vibratory rammer injects lubricating oil into a carburetor adapter attaching the engine's carburetor to the engine block. Oil injected at this location is dispersed with the atomized air/fuel mixture in the carburetor just before the resultant air/fuel/oil mixture enters the engine's combustion chamber through the intake port. The recently dispersed oil does not have an opportunity to be thoroughly atomized prior to being mixed with air and inducted into the engine's combustion chamber. As a result, the lubricating qualities of the oil are reduced, and the oil does not burn as completely as it would if the oil were adequately atomized prior to its combustion. This lack of complete combustion reduces the engine's efficiency, increases its emissions, and leads to a buildup of carbon deposits inside the engine's combustion chamber and exhaust port.

Another problem associated with the above-described rammer is that it is relatively invasive. Its pump is driven directly by the engine's drive shaft. The existing engine crankcase as supplied by the engine manufacturer must be modified significantly to accommodate the pump. This requirement to modify an engine crankcase to permit post-engine-manufacturing mounting of the pump in the crankcase substantially increases the overall cost and complexity of the rammer.

The need therefore has arisen to provide an oil supply system for a two-cycle engine of a reciprocating impact tool, such as a rammer or a breaker, that injects lubricating oil into the engine's fuel supply system so as to assure good atomization of the oil prior to induction of the fuel/oil mixture into the combustion chamber(s) of the engine.

The need has also arisen to provide an oil injection system for a two-cycle engine of a reciprocating impact tool that requires no modifications to the existing engine crankcase.

SUMMARY OF THE INVENTION

In accordance with a first aspect of the invention, at least some of the above-identified needs, are satisfied by providing a reciprocating impacting machine comprising a two-cycle engine and a reciprocating impact tool. The engine includes a cylinder which has an intake port, a rotatable output shaft which is coupled to the cylinder, a fuel supply system, and an oil supply system. The fuel supply system includes a fuel tank, a fuel supply device that supplies a mixture of fuel and oil to the cylinder, and a fuel supply line leading from the fuel tank to the fuel supply device. The oil supply system supplies the lubricating oil to the fuel supply device. It includes an oil source, an oil supply pump having an oil inlet connected to the oil source and having an oil outlet, and an oil supply line connecting the oil outlet of the oil supply pump to the fuel supply line. The reciprocating impact tool is coupled to the engine output shaft and reciprocates against the ground upon engine output shaft rotation. The impact tool, the fuel supply system, and the oil supply system are configured such that operation of the reciprocating impact tool agitates oil in the fuel supply line sufficiently to thoroughly mix the oil in the fuel supply line with the fuel in the fuel supply line.

In order to reduce the build-up of carbon deposits in the engine's combustion chamber(s) and exhaust port(s), the oil preferably is supplied only when the impact tool is operating. In order to achieve this effect, a centrifugal clutch may couple the engine output shaft to the oil supply pump and the reciprocating impact tool so that the oil supply pump is only operated when the engine RPM exceeds a designated threshold. In this case, the pump may be driven by the same drive gear that drives the reciprocating impact tool.

In order to maximize the agitation effects of machine operation on fuel and oil in the fuel supply line, the fuel supply line may comprise a flexible supply line, and the oil supply line may be coupled to the fuel supply line at a location which is remote from the fuel supply device. This spacing should be at least 6".

In accordance with another aspect of the invention, a method of fueling a reciprocating impact machine comprises supplying a fuel/oil mixture to a supply device of a two-stroke engine by feeding fuel into the fuel supply line from the fuel tank, pumping oil from the oil source to the fuel supply line, and thoroughly mixing oil with fuel in the fuel supply line to form the fuel/oil mixture by agitating at least a substantial portion of the fuel supply line that includes the fuel/oil mixture. The agitating step results at least in substantial part by operation of the reciprocating impact tool.

In order to avoid carbon build-up in the engine's combustion chamber and exhaust port by supplying lube oil when it is unnecessary to do so, the pumping step preferably is performed only at engine speeds above a designated engine speed.

In accordance with still another aspect of the invention, an improved method of assembling a reciprocating impact tool comprises providing 1) an engine crankcase that supports a cylinder, a fuel tank, a fuel supply device coupled to the cylinder, and a fuel supply line leading from the fuel tank to the fuel supply device and an input element of a centrifugal clutch, and 2) a tool crankcase that supports a reciprocatable impact tool, an oil supply pump, and an output element of the centrifugal clutch. Subsequent steps include connecting the engine crankcase to the tool crankcase and connecting one end of an oil supply line to an output of the oil supply pump and another end of the oil supply line to the fuel supply line at a location remote from the fuel supply device.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and no t of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Resume

Pursuant to the invention, a reciprocating impact tool such as a rammer or a breaker is provided with a lubricating oil supply system that supplies lubricating oil to a fuel supply line of the tool's two-cycle engine, thereby eliminating the need to premix the fuel and oil. The oil is supplied at a rate that varies with the speed of the reciprocating member of the tool, thereby assuring that the fuel and oil are mixed in the proper proportions. The oil pump delivers oil to the fuel supply line well-upstream of the engine's carburetor or other fuel supply device, thereby taking advantage of movement and vibration of the reciprocating member to assure that the delivered oil is thoroughly mixed with the fuel in the fuel line before the mixture is inducted into the engine's combustion chamber, leading to complete atomization of the oil and resultant benefits, including improved lubrication and complete combustion of the oil. The invention requires no modifications to the existing engine crankcase design because the oil supply system's pump is coupled to and driven by the reciprocating member's drive train as opposed to the engine.

2. System Overview

The inventive oil supply system is usable with a variety of reciprocating impact tools powered by a two-cycle engine. Tools of this type include, but are not limited to, rammers and breakers. Hence, while a preferred embodiment will now be described in conjunction with a rammer, it is to be understood that it is usable with a variety of other reciprocating impact tools that sufficiently agitate a fuel supply line to thoroughly mix oil and fuel in that line and to facilitate atomization of the oil in the engine's carburetor or other fuel supply device.

Figure 1:
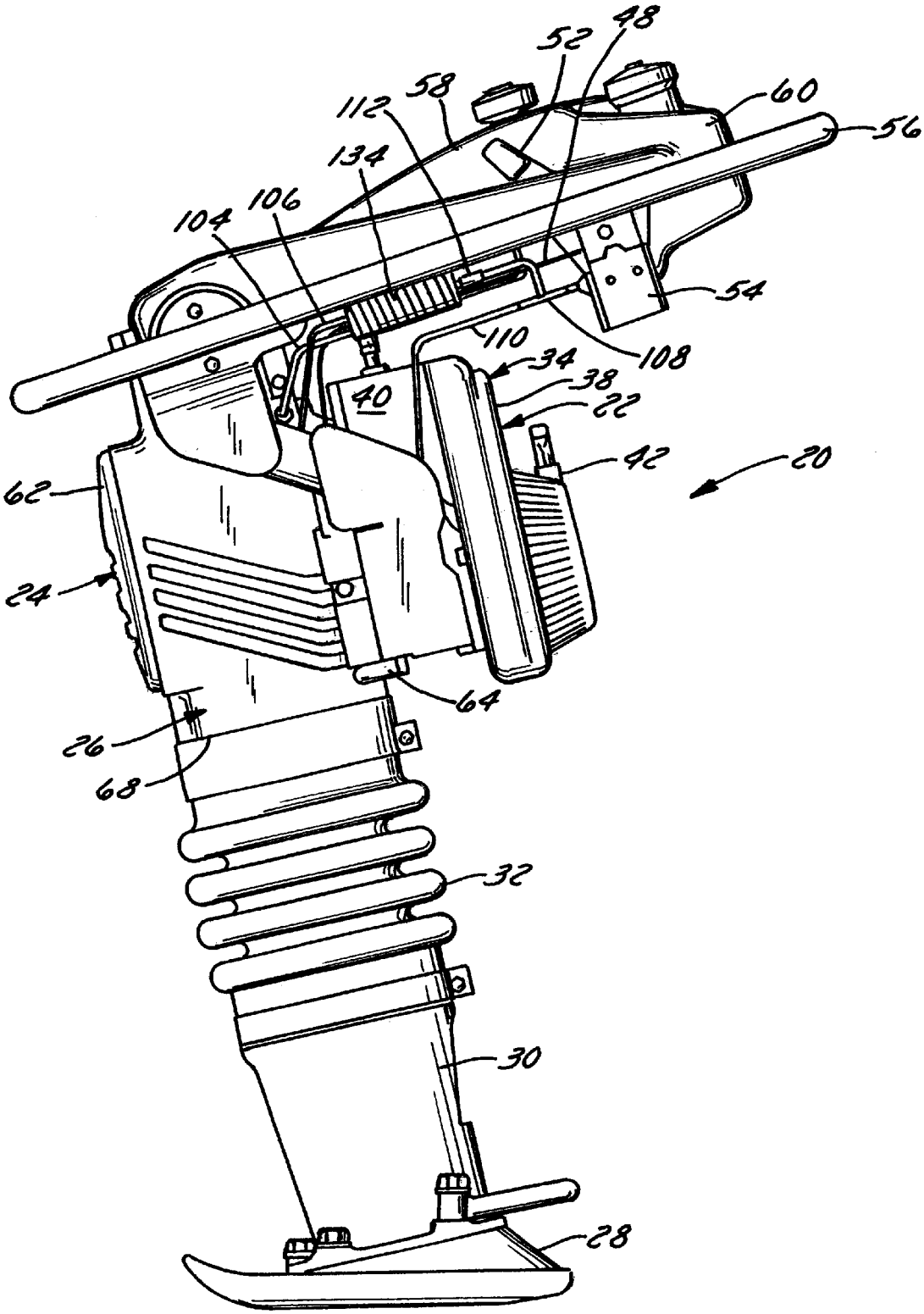
FIG. 1 is a side elevation view of a rammer incorporating a lubricating oil supply system constructed in accordance with a preferred embodiment of the present invention.
Figure 2:
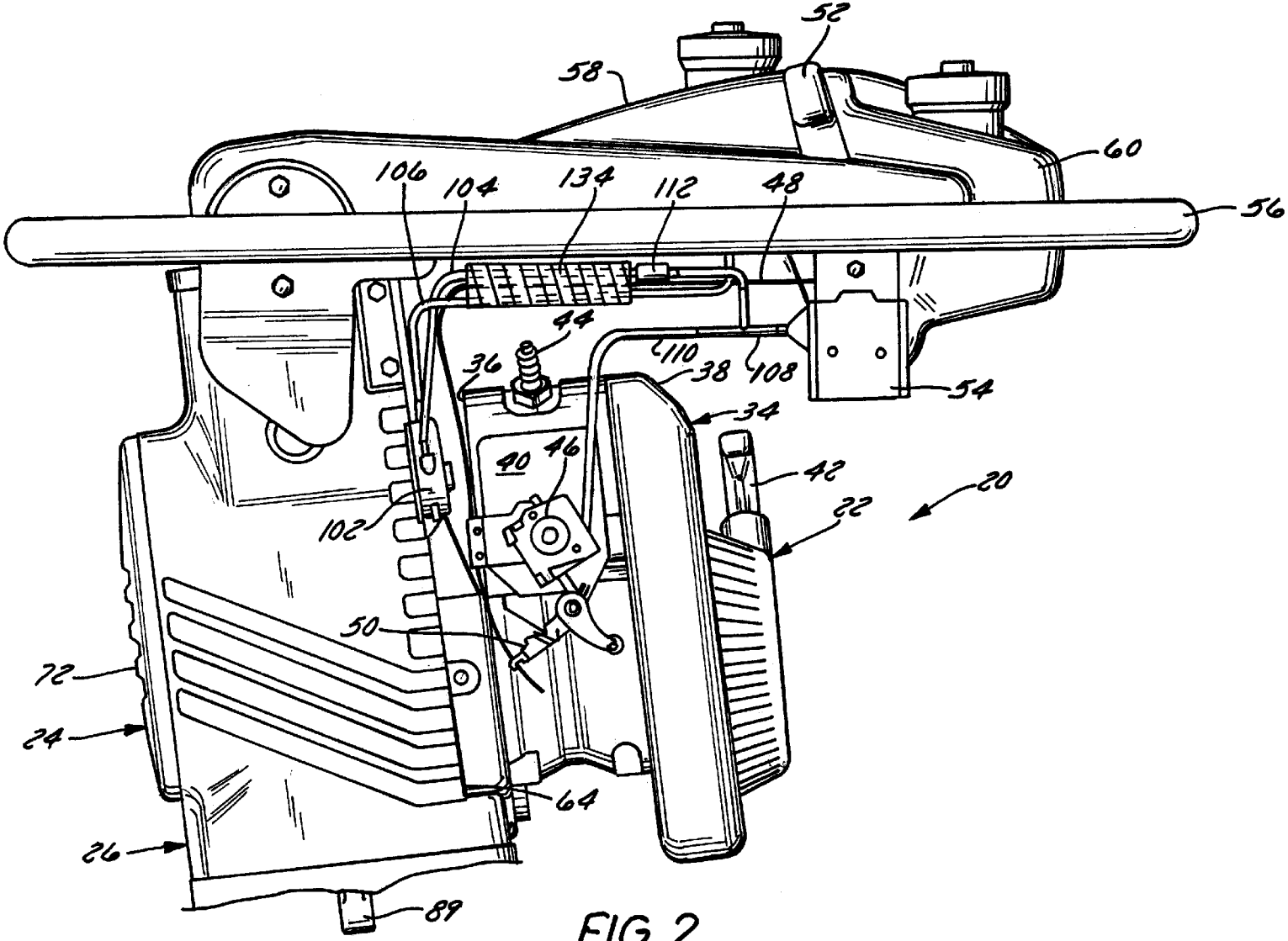
FIG. 2 is a side elevation view of an upper portion of the rammer of FIG. 1.
Figure 3:
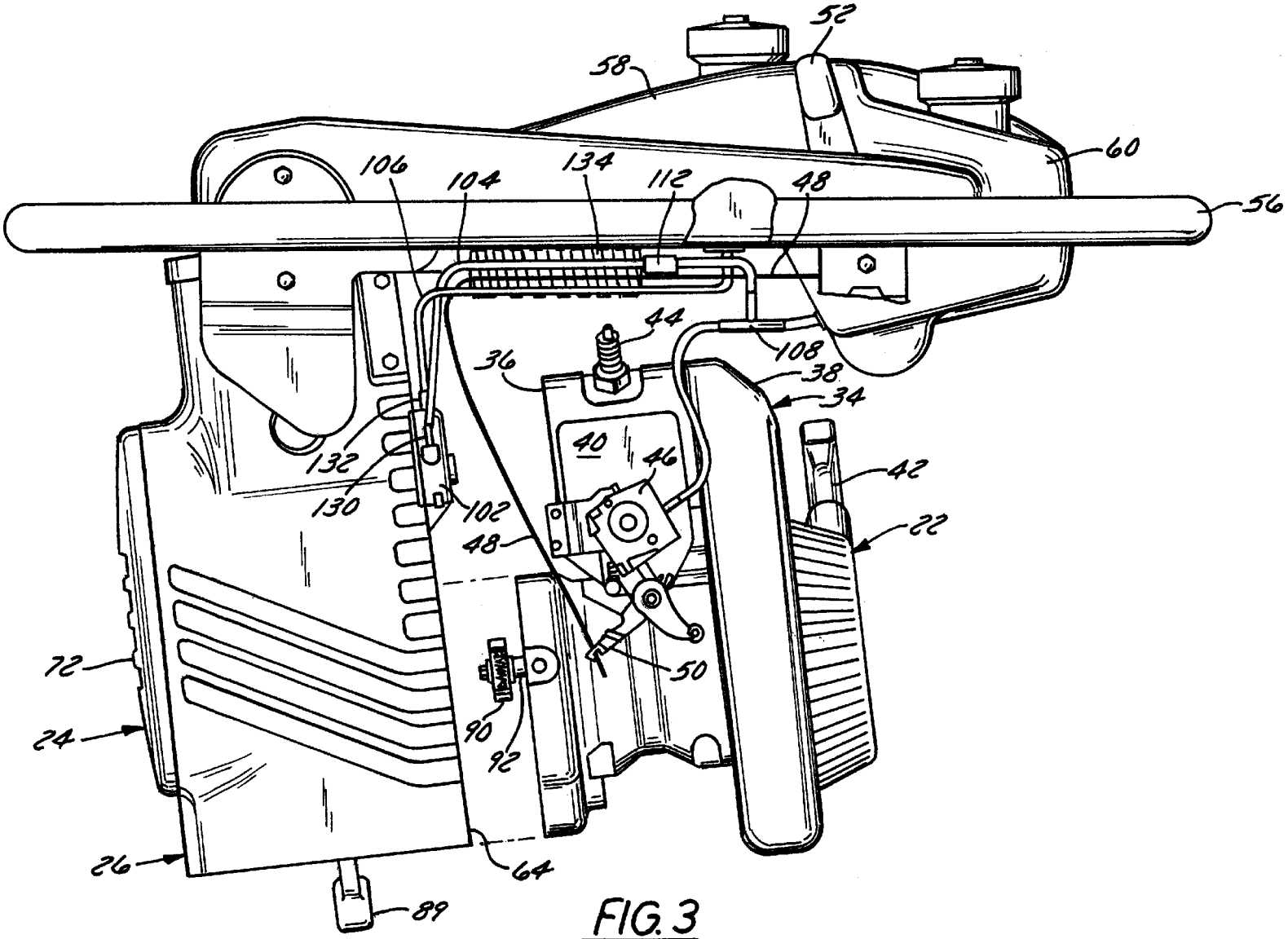
FIG. 3 generally corresponds to FIG. 2 but shows detachment of an engine of the rammer from a rammer assembly of the rammer.

Referring now to the drawings and initially to FIGS. 1–3, a rammer (sometimes known as a tamper) 20 is illustrated that includes an engine 22 and a rammer subassembly 24 bolted to one another to form an integral unit. The rammer subassembly 24 includes a rammer crankcase 26 and a reciprocating rammer member 28 extending downwardly from the rammer crankcase 26. The rammer member 28 comprises a tamping shoe connected to the rammer crankcase 26 by a reciprocating piston (not shown) so as to oscillate or reciprocate vertically upon rammer operation. The piston is protected at its lower end by a fixed guard 30 and at its upper end by a flexible boot 32 that accommodates movement of the shoe 28 relative to the rammer crankcase 26.

Still referring to FIGS. 1–3, the engine 22 comprises a two-cycle, spark ignited, single-cylinder, internal combustion engine. The cylinder (not shown) is encased in a crankcase 34 having a front surface 36, a rear surface 38, and a generally circular cylindrical side surface 40. The front surface 36 includes a mounting portion that is bolted to a corresponding mounting portion on a rear surface of the rammer crankcase 26 as detailed below. The engine 22 is started via a pull-chord 42 mounted on the rear surface 38 of the crankcase 34. The engine 22 is supplied with spark via a spark plug 44 and with fuel via a fuel supply device 46, both of which are mounted on the side surface 40 of the engine crankcase 34. The fuel supply device 46 could comprise a fuel injector but, in the illustrated embodiment, comprises a conventional carburetor. Airflow to the carburetor 46 is controlled by a throttle 50, which is actuated by a throttle control lever 52 connected to the throttle 50 via a throttle cable 48. As is conventional, the carburetor 46 mixes incoming air and fuel together and supplies the air/fuel mixture to the combustion chamber (not shown) of the engine's cylinder.

A support frame 54 is mounted on the upper end of the rammer crankcase 26 and extends rearwardly over the top of the engine 22. An operator's handle 56 is formed from the side and rear end portions of support frame 54. Oil and fuel tanks 58 and 60 are also mounted on the frame 54 for supplying lubricating oil and fuel to the engine 22. Finally, the throttle control lever 52 is mounted near the rear end of frame 54.

Figure 4:
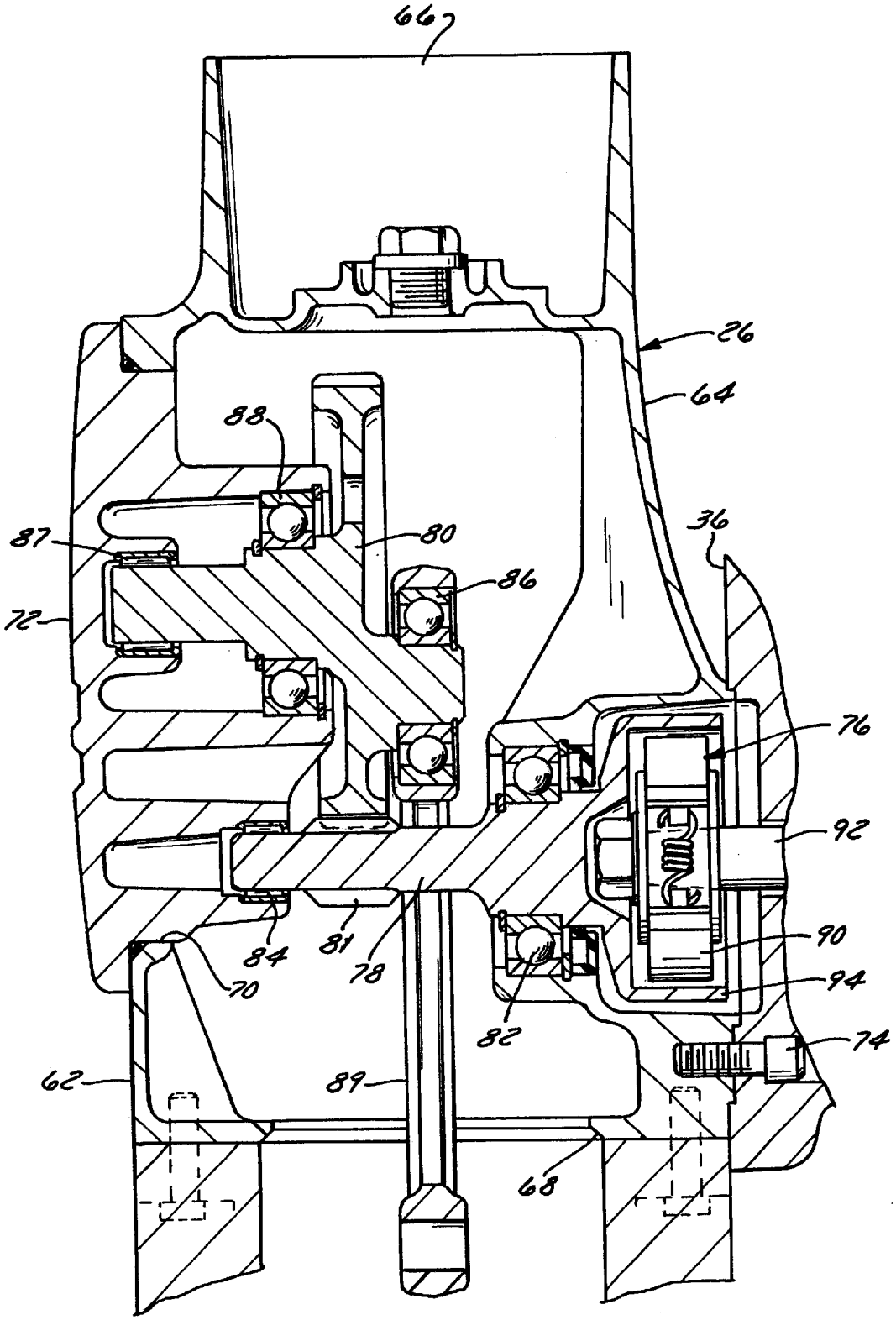
FIG. 4 is a side sectional elevation view of a portion of the rammer, taken through a clutch and drive gear of the rammer.

Referring now to FIGS. 2–4 and particularly to FIG. 4, the rammer crankcase 26 comprises a generally rectangular cast metal housing having front, rear, top, and bottom surfaces 62, 64, 66, and 68. Access to the interior of the rammer crankcase 26 is provided by an access opening 70 in the front surface 62 of the crankcase 26. The access opening 70 is normally closed by a cover 72 that doubles as a bearing support surface for the clutch output shaft 78 and a rammer drive gear 80 as detailed below. The rear surface 64 is bolted to the front surface 36 of the engine crankcase 34 by bolts 74. Mating apertures are formed in the front surface 36 of the engine crankcase 34 and the rear surface 64 of the rammer crankcase 26 to form a chamber that accommodates a centrifugal clutch 76. The clutch 76 has an output shaft 78 that drives the rammer drive gear 80 via a pinion 81. An eccentric crank 89, mounted on the drive gear 80, reciprocates upon driven gear rotation to drive the piston and tamper shoe 28 to reciprocate linearly.

As best seen in FIG. 4, the centrifugal clutch 76 includes (1) a drive hub 90 mounted on an engine output shaft 92 and (2) a driven hub 94 that drives the driven shaft 78 of the clutch 76. This arrangement provides a modular assembly whereby the same engine 22 and clutch 76 could be used with a variety of different rammer crankcase arrangements. (This benefit of the tool is highlighted by FIG. 3, which shows that the engine 22 can be removed from the rammer subassembly 24 with the drive hub 90 of the clutch 76 remaining with the engine 22 and the remainder of the clutch 76 remaining with the rammer assembly 24.) The output shaft 78 is supported in the rammer crankcase 26 by first and second bearings 82 and 84. Similarly, the drive gear 80 is supported in the rammer crankcase 26 by bearings 86, 87, and 88. The drive gear 80 is coupled to the drive piston for the tamping shoe 28 via an eccentric crank 89 mounted to the outer axial surface of the drive gear.

3. Construction and Operation of Oil Supply System

Figure 5:
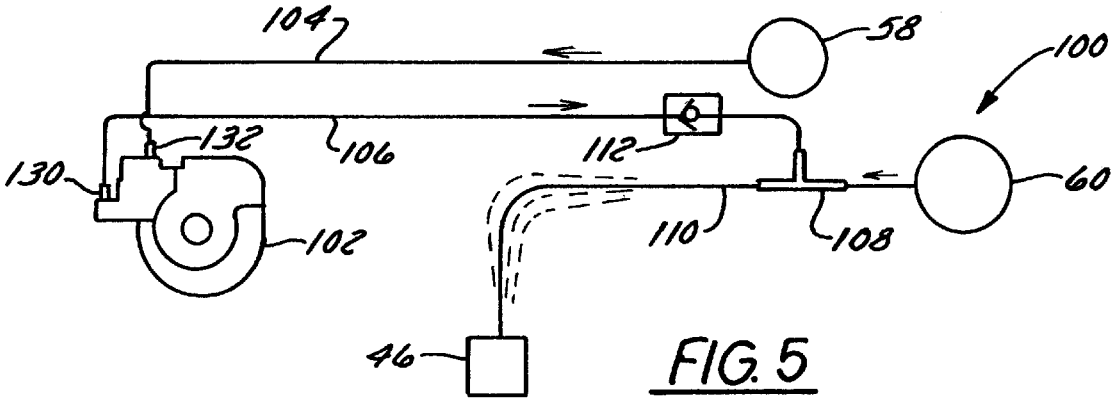
FIG. 5 schematically illustrates an oil supply system of the rammer.
Figure 6:
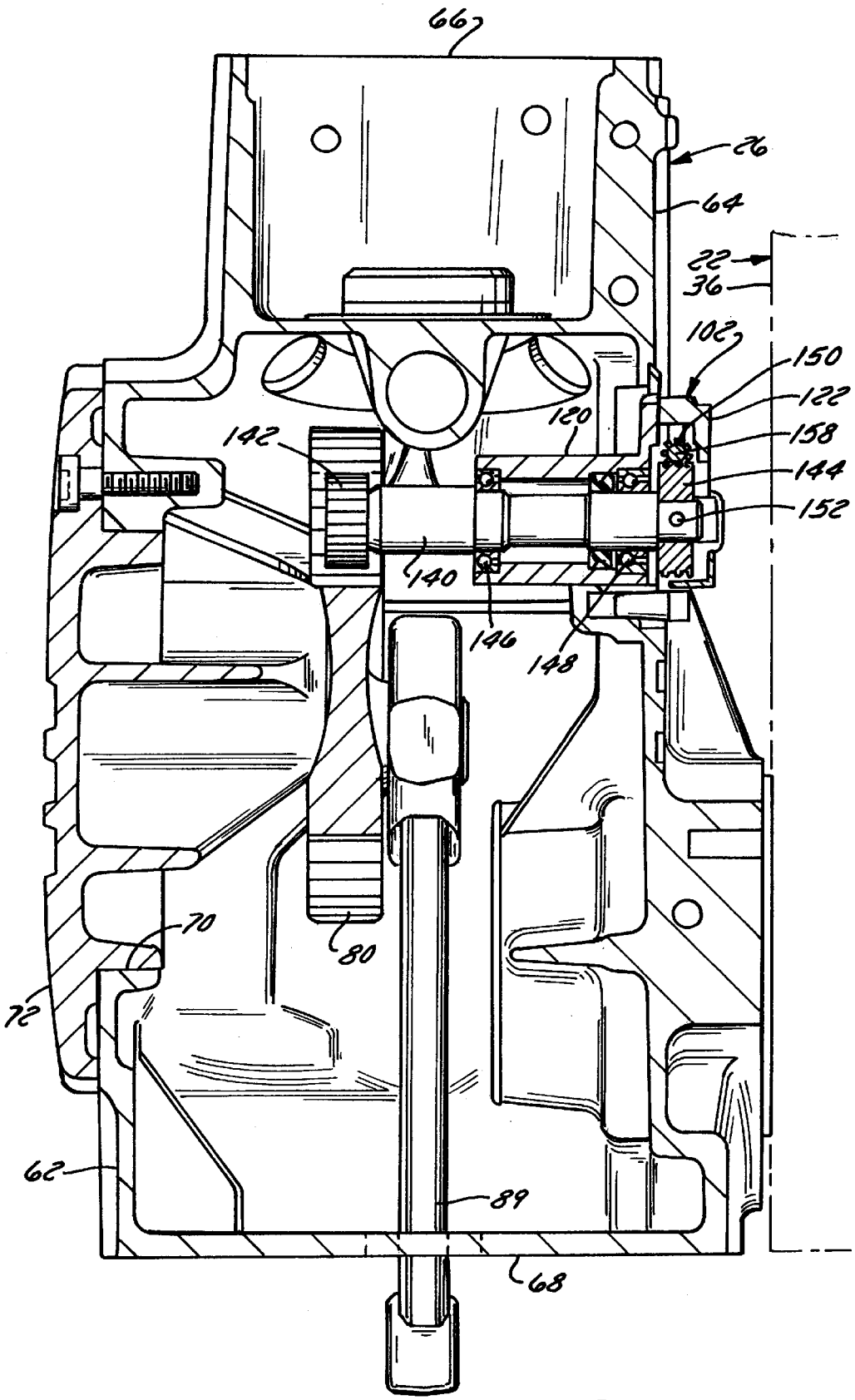
FIG. 6 is a side sectional elevation view of a portion of the rammer, taken through an oil supply pump drive shaft of the oil supply system.
Figure 7:
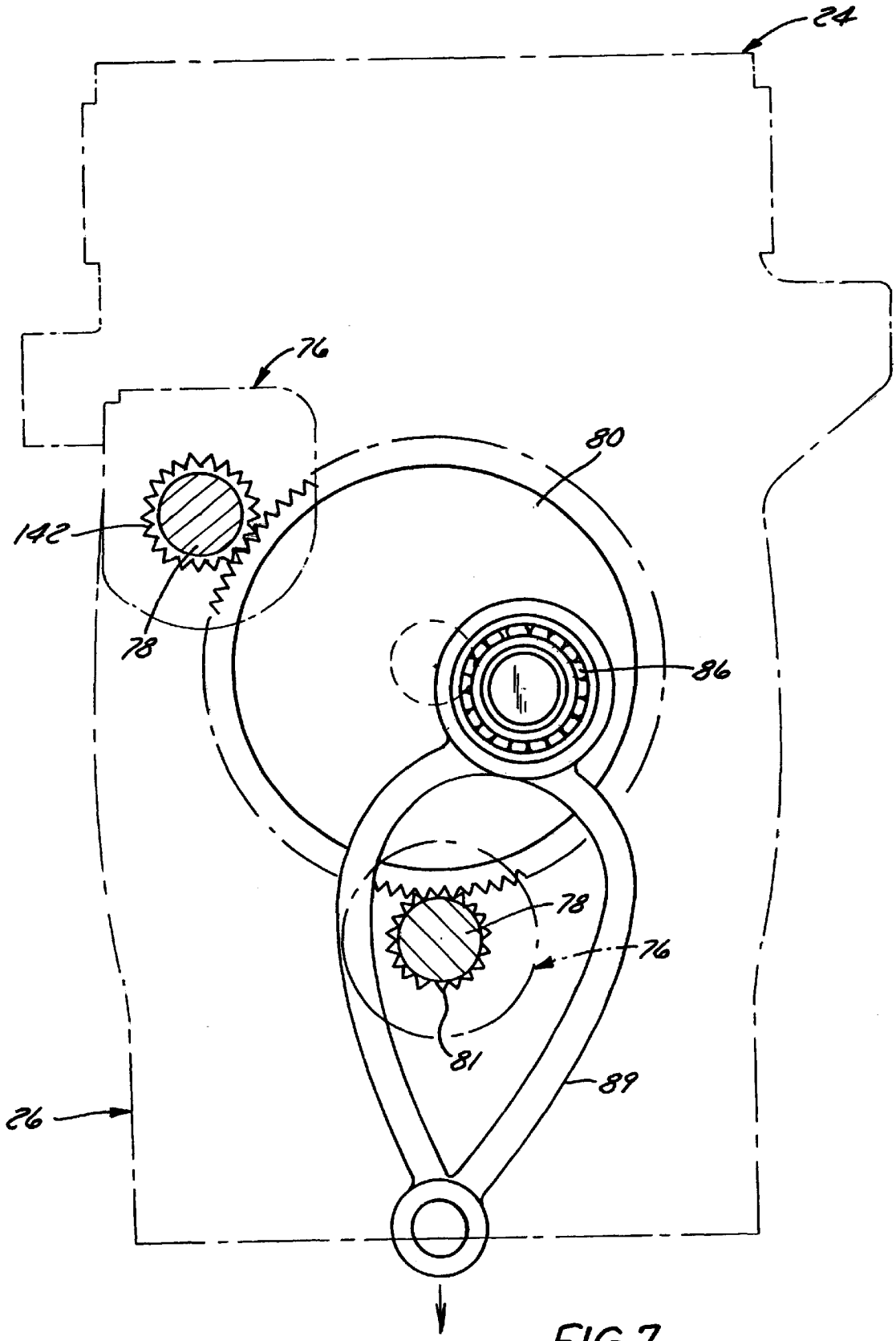
FIG. 7 is a partially schematic, partially sectional end elevation view showing the cooperation between the rammer drive gear, the clutch, and the oil supply pump drive system.

As discussed briefly above, the rammer 20 incorporates an oil supply system that supplies a metered quantity of lubricating oil to the engine's fuel supply system. Referring now to FIG. 5, the oil supply system 100 of the illustrated embodiment comprises the oil tank 58, an oil supply pump 102, and first and second oil lines 104 and 106. The first oil line 104 leads from the oil tank 58 to an inlet 132 of the pump 102. The second oil line 106 leads from an outlet 130 of the pump 102 to a T-connector 108 coupled to a supply line 110 leading from the fuel tank 60 to the carburetor 46. A check valve 112 is disposed in the oil supply line 106 just upstream of the T-connector 108 to prevent reverse flow of oil and/or fuel to the pump 102 from the T-connector 108. By remaining closed in the absence of oil pressure on the order of 1–2 psi in the oil supply line, the check valve 112 also prevents oil in supply line 106 from draining into the fuel supply line while the rammer is not in operation. The pump 102 draws oil from the oil supply tank 58, through the first supply line 104, and forces it through the second oil supply line 106, into the T-connector 108, and into the fuel supply line 110 at a controlled rate to form a fuel/oil mixture. The fuel supply line 110 then delivers the fuel/oil mixture to the carburetor 46.

Figure 8:
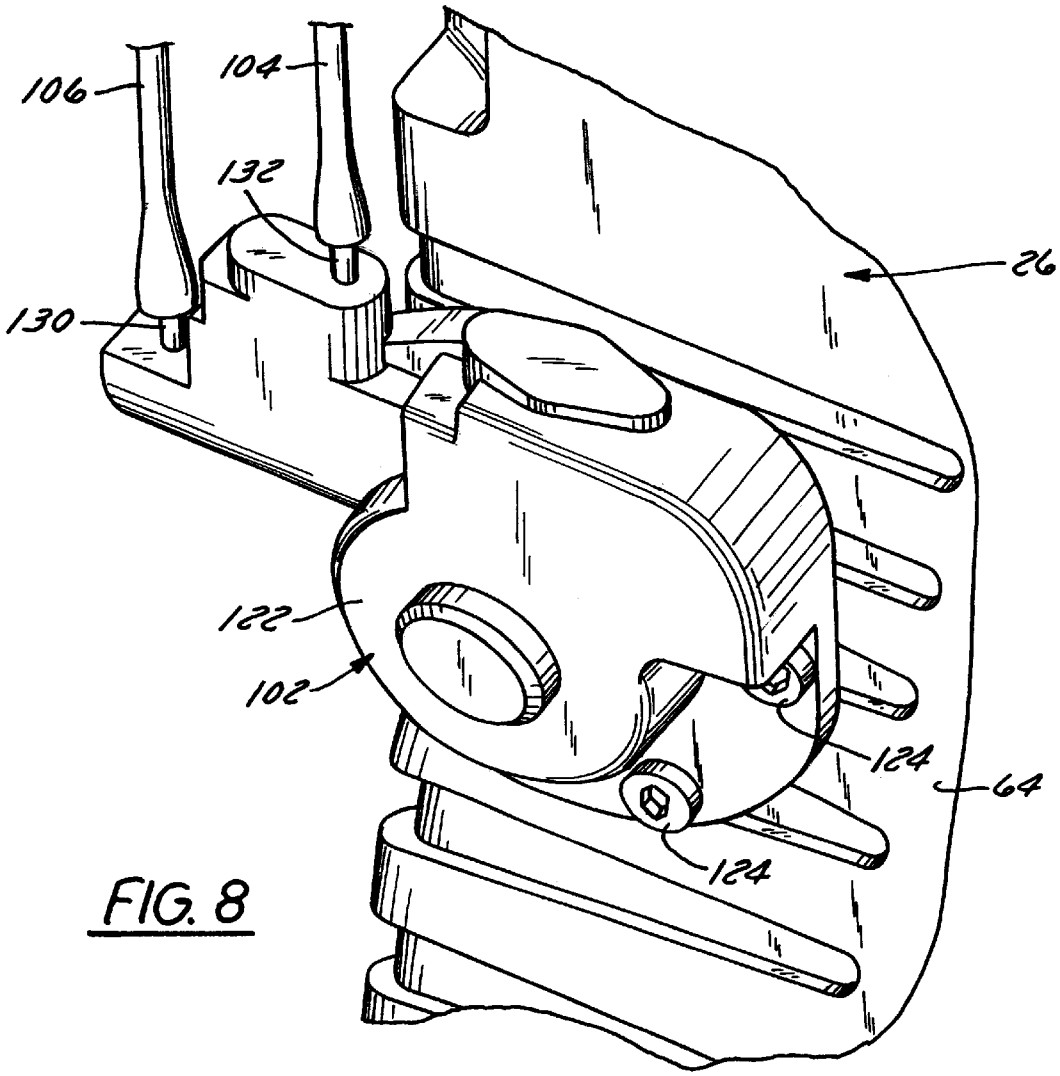
FIG. 8 is a perspective view of the oil supply pump of the oil supply system.
Figures 9, 10:
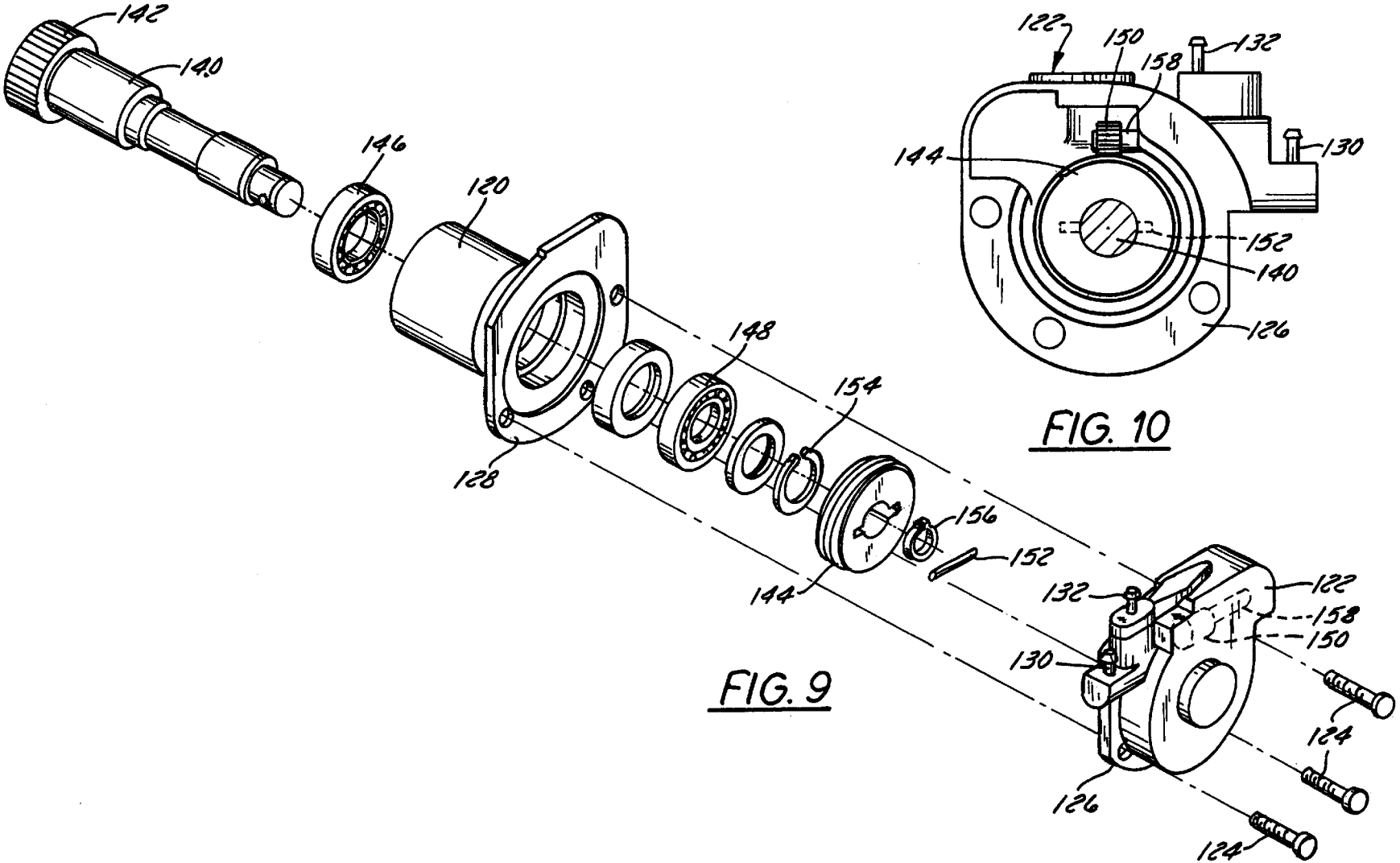
FIG. 9 is an exploded perspective view of the oil supply pump.
FIG. 10 is a sectional end elevation view of the oil supply pump.
Figure 11:
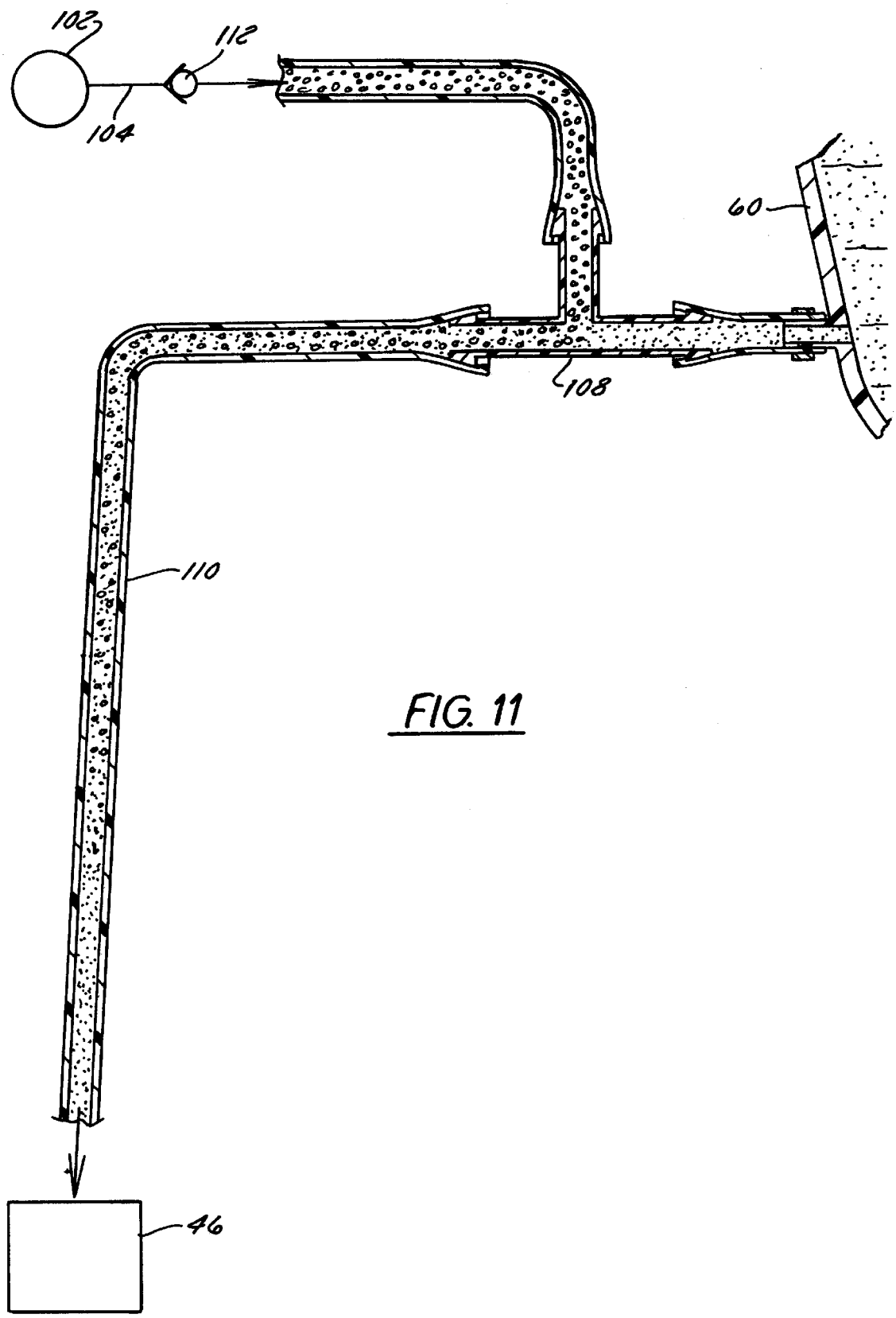
FIG. 11 is a sectional side elevation view of a portion of a fuel supply line of the rammer's fuel supply system, showing mixing of oil in the fuel supply line.

The pump 102 preferably is driven by the rammer subassembly's gear train, thereby withholding lubricating oil supply when the engine 22 is idling and preventing carbon buildup within the cylinder's combustion chamber and exhaust port. It may comprise any of a variety of pumping devices driven directly or indirectly by the rammer subassembly's drive train. In the illustrated embodiment, the pump 102 is a positive displacement pump driven by the drive gear 80 of the rammer subassembly's drive train. Referring now to FIGS. 6–10, the pump 102 is housed in a housing mounted in an opening formed in the rear wall 64 of the rammer crankcase 26. The housing includes (1) a tubular portion 120 and a cover portion 122. The tubular portion 120 extends into the opening in the crankcase 26. The cover portion 122 is mounted on the external surface of the rear wall 64 of the crankcase 26. The housing is attached to the rammer crankcase 26 by a plurality of bolts 124 as best seen in FIGS. 8–10. The bolts 124 extend through a peripheral flange 126 on the cover portion 122, through a flange 128 on the outer surface of the tubular portion 120, and into tapped bores in the rear surface 64 of the rammer crankcase 26. Outlet and inlet ports 130 and 132 are formed on the upper surface of the cover portion 122. As discussed above, the inlet port 132 is connected to the first oil line 104 leading to the oil tank 58, and the outlet port 130 is connected to the second oil line 106 leading to the T-connector 108. Both oil lines 104 and 106 are preferably protected from damage by holding them together using a spiral wrap 134 (FIG. 2).

Still referring to FIGS. 6–10, the operative components of the pump 102 include a pumping arrangement that performs the actual pumping function and a torque transfer arrangement that transfers torque from the rammer subassembly's drive train to the pumping arrangement. The torque transfer arrangement includes a drive shaft 140, a drive pinion 142, and a worm gear 144. The drive shaft 140 is mounted in the inner portion of the pump housing 120 via first and second bearings 146 and 148. The pinion 142 is mounted on a first end of the drive shaft 140 and meshes directly with the rammer drive gear 80. The worm gear 144 is mounted on a second end of the drive shaft 140 and drives a worm 150 of the pumping arrangement.

The pumping arrangement includes the worm 150 and a pump shaft 158, both mounted in the cover portion 122 of the pump housing. The pump shaft 158 extends at a right angle from the drive shaft 140 and rotates with the worm 150. As is conventional with positive displacement pumps of this type, rotation of the pump shaft 158 draws fluid into the cover portion 122 from the inlet port 132 and forces the oil out of the cover portion 122 through the outlet port 130 and at a rate that varies with the rotational speed of the pump shaft 158.

Referring now to FIGS. 1–3 and 11, the T-connector 108 preferably is located in a substantial distance from the carburetor 46. In addition, the fuel supply line 110 leading from the T-connector 108 to the carburetor 46 preferably has substantial slack in it and, unlike the oil lines 104 and 106, is not strapped in place. The fuel supply line 110 is also flexible, preferably being formed from rubber or the like. As a result, vibrations and reciprocating motion of the rammer 20 agitate the fuel supply line 110 sufficiently to thoroughly mix the oil with the fuel in that line and to facilitate complete atomization of the oil prior to its induction into the combustion chamber. In order to maximize the dwell time of oil in the supply line and maximize the agitating efforts of rammer operation on that oil, the oil is injected into the fuel supply line 110 at least six inches, and even more preferably at least ten inches, from the carburetor 46. In practice, the supply line portion leading from the carburetor to the T-connector 108 is about one foot long.

In operation, the engine 22 is started by pulling the chord 42 and thereafter runs on straight gasoline so long as the engine 22 is idling and the rammer tamper shoe 28 is not driven to reciprocate. This running on straight gasoline at engine idle not only is not harmful, but actually has been found to be beneficial because the typical fuel/oil mixture is set so as to provide adequate lubrication at high load or high rpm. This mixture would provide excessive lubrication at low load and low rpm, resulting in carbon buildup within the engine's combustion chamber and exhaust port. By disabling the supply of lube oil to the engine at these low rpms (on the order of less then 2600–2800 rpm), that carbon buildup is eliminated or at least substantially reduced.

When the engine 22 is accelerated to initiate a compaction operation, the output hub 94 of the centrifugal clutch 76 is driven to rotate. The output hub 94 then drives the drive gear 80 to rotate, which in turn causes the crank 89 to reciprocate vertically to initiate a ramming action. Drive gear rotation also drives the pump drive shaft 140 to rotate at a rate that is proportional to the rotational speed of the drive gear 80. As a result, oil is pumped from the oil tank 58, through the pump 102, and to the second oil supply line 106 at a rate that is proportional to drive gear speed and, accordingly, engine load. The oil flows through the oil supply line 106, through the check valve 112, through the T-connector 108, and is injected into the fuel supply line 110, where it joins the gasoline flowing through line 110 from the fuel tank 60 to form a fuel/oil mixture. Because the flow rates of fuel and oil into the line 110 are matched, the fuel/oil mixture is generally constant through the operating range of the rammer 20. That ratio will vary from application to application, depending upon the type of engine used. The ratio typically will be at least 50:1, and may often be 100:1. In fact, the pump 102 is particularly well-suited for engines having very high fuel:oil ratios on the order of 100:1 because mixing the appropriate proportions of fuel and oil is particularly critical in those applications.

Referring now to FIG. 1, the movement of the tamper shoe 28 and the vibrations of the rammer 20 agitate the fuel/oil mixture in the fuel supply line 110 so that the oil is progressively mixed with the fuel as the fuel and oil move through the fuel supply line 110. As a result, the oil in downstream portions of the line 110 is thoroughly mixed with the fuel. Without this agitation, the oil and fuel would tend to flow into the carburetor 46 in separate streams, with the oil taking the form of larger drops. The thorough mixing resulting from this agitation assures that the oil in the mixture is fully atomized and mixed with the incoming air in the carburetor 46 before entering the combustion chamber of the cylinder. This atomization and mixing with the air assures complete combustion of nearly all of the oil in the fuel/oil mixture, resulting in better lubrication of the engine 22 and lowering the risk of excessive carbonization within the combustion chamber and/or the engine cylinder exhaust port.

Many changes and modifications may be made to the present invention without departing from the spirit thereof. The scope of some of these changes are discussed above. The scope of other changes will become apparent from the appended claims,

We claim:

1. A reciprocating impacting machine comprising:

(A) a two-cycle engine including (1) a cylinder which has an intake port, (2) a rotatable output shaft which is coupled to said cylinder, (3) a fuel supply system which includes a fuel tank, a fuel supply device that supplies a mixture of fuel and oil to said cylinder, and a fuel supply line leading from said fuel tank to said fuel supply device, and (4) an oil supply system which supplies oil to said fuel supply device, said oil supply system including (a) an oil source, (b) an oil supply pump having an oil inlet connected to said oil source and having an oil outlet, and (c) an oil supply line connecting said oil outlet of said oil supply pump to said fuel supply line; and (B) a reciprocating impact tool which is coupled to said engine output shaft and which reciprocates against the ground upon engine output shaft rotation, wherein said impact tool, said fuel supply system, and said oil supply system are configured such that operation of said reciprocating impact tool agitates oil in said fuel supply line sufficiently to thoroughly mix the oil in said fuel supply line with the fuel in said fuel supply line.

2. The impacting machine as recited in claim 1, further comprising a centrifugal clutch having an input which is coupled to said engine output shaft and an output which is coupled to said oil supply pump and said reciprocating impact tool.

3. The impacting machine as recited in claim 2, further comprising a drive gear which is driven by said centrifugal clutch and which drives said reciprocating impact tool and said oil supply pump.

4. The impacting machine as recited in claim 3, further comprising an engine crankcase on which said engine and an input hub of said clutch are mounted, and a tool crankcase on which said drive gear, said oil supply pump, and an output hub of said clutch are mounted.

5. The impacting machine as recited in claim 3, wherein said oil supply pump is a positive displacement pump comprising a pump housing having inlet and outlet ports forming the inlet and outlet of said pump, respectively, a driven gear which is driven by said drive gear, a worm gear which is driven by said driven gear, and a shaft which is located in said pump housing, which rotates with said worm gear, and which pumps oil from said inlet port to said outlet port.

6. The impacting machine as recited in claim 1, wherein said fuel supply line comprises a flexible supply line, and wherein said oil supply line is coupled to said fuel supply line at a location which is remote from said fuel supply device.

7. The impacting machine as recited in claim 6, wherein said location is spaced from said fuel supply device by at least 6".

8. The impacting machine as recited in claim 6, wherein said location is spaced from said fuel supply device by at least 10".

9. The impacting machine as recited in claim 6, further comprising a check valve which is located in said oil supply line.

10. The impacting machine as recited in claim 1, wherein said fuel supply device comprises a carburetor.

11. The impacting machine as recited in claim 1, wherein said reciprocating tool comprises one of a rammer and a breaker.

12. A reciprocating impacting machine comprising:

(A) a two-cycle engine including
  (1) an engine crankcase,
  (2) a cylinder which is located in said engine crankcase and which has an intake port,
  (3) a rotatable output shaft which is coupled to said cylinder,
  (4) a fuel supply system which includes
    (a) a fuel tank,
    (b) a carburetor,
    (c) a fuel supply line leading from said fuel tank to said carburetor, and (B) an impact tool assembly including
  (1) a tool crankcase,
  (2) a reciprocating impact tool which is mounted on said tool crankcase and which reciprocates linearly upon engine output shaft rotation, said reciprocating impact tool comprising one of a rammer and a breaker,
  (3) an oil supply system which supplies oil to said fuel supply line, said oil supply system including
    (a) an oil source,
    (b) an oil supply pump mounted on said tool crankcase and having an oil inlet connected to said oil source and an oil outlet, and
    (c) an oil supply line connecting said oil outlet of said oil supply pump to said fuel supply line, said oil supply line being connected to said fuel supply line at a location which is at least 6" from said carburetor;

(C) a centrifugal clutch which couples said engine output shaft to said reciprocating impact tool and to said oil supply pump, said centrifugal clutch including an input hub mounted on said engine crankcase and an output hub mounted on said tool crankcase, wherein said reciprocating impact tool, said fuel supply system, and said oil supply system are configured such that operation of said reciprocating impact tool sufficiently agitates oil in said fuel supply line to thoroughly mix the oil in said fuel supply line with the fuel in said fuel supply line.

13. The impacting machine as recited in claim 12, wherein said oil supply pump is a positive displacement pump comprising a pump housing which is mounted on said tool crankcase and which has inlet and outlet ports forming the inlet and outlet of said pump, respectively, a driven gear which is driven by said drive gear, a worm gear which is driven by said driven gear, and a shaft which is located in said pump housing, which rotates with said worm gear, and which pumps oil from said inlet port to said outlet port.

14. The impacting machine as recited in claim 12, further comprising a check valve which is located in said oil supply line.

15. A method comprising:

(A) providing a two-cycle engine including
  (1) a cylinder which has an intake port,
  (2) a fuel supply system which includes a fuel tank, a fuel supply device, and a fuel supply line leading from said fuel tank to said fuel supply device, and
  (3) an oil source, (B) providing a reciprocating impact tool which is coupled to said engine, (C) operating said engine to drive said reciprocating impact tool to impact against the ground, (D) during operation of said engine, supplying a fuel/oil mixture to said fuel supply device by
  (1) feeding fuel into said fuel supply line from said fuel tank,
  (2) pumping oil from said oil source to said fuel supply line,
  (3) thoroughly mixing oil with fuel in said fuel supply line to form a fuel/oil mixture by agitating at least a substantial portion of said fuel supply line that includes said fuel/oil mixture, the agitating step resulting at least in substantial part by operation of said reciprocating impact tool.

16. The method as recited in claim 15, wherein the pumping step is performed only at engine speeds above a designated engine speed.

17. The method as recited in claim 16, wherein the pumping step comprises supplying drive torque to an oil supply pump via operation of a centrifugal clutch whose output is driven to rotate only at engine speeds exceeding an engine idling speed.

18. The method as recited in claim 16, wherein the reciprocating impact tool is coupled to the engine via a centrifugal clutch having an output which drives the reciprocating impact tool.

19. The method as recited in claim 15, wherein the pumping step comprises pumping oil to said fuel supply line so as to form a fuel/oil mixture having a fuel-to-oil ratio of more than 50:1.

20. The method as recited in claim 15, wherein the pumping step comprises pumping oil to said fuel supply line so as to form a fuel/oil mixture having a fuel-to-oil ratio of about 100:1.

21. The method as recited in claim 15, further comprising directing the oil/fuel mixture into a carburetor, thoroughly atomizing the oil in said carburetor, and mixing the atomized oil and fuel with air, directing the mixture into a combustion cylinder of said engine, and combusting the fuel and the oil within said mixture.

22. A method of assembling a reciprocating impact tool, comprising:

(A) providing an engine crankcase that supports a cylinder, a fuel tank, a fuel supply device coupled to said cylinder, a fuel supply line leading from said fuel tank to said fuel supply device, and an input element of a centrifugal clutch;

(B) providing a tool crankcase that supports a reciprocatable impact tool, an oil supply pump, and an output element of said centrifugal clutch;

(C) connecting said tool crankcase to said engine crankcase; and (D) connecting one end of an oil supply line to an output of said oil supply pump and another end of said oil supply line to said fuel supply line at a location remote from said fuel supply device.

* * * * *